United States Patent [19]

Berg

[11] 3,981,108

[45] Sept. 21, 1976

[54] REGLET STRUCTURE

[76] Inventor: Edward T. Berg, 187 Fremont St., San Francisco, Calif. 94105

[22] Filed: Apr. 23, 1975

[21] Appl. No.: 570,590

Related U.S. Application Data

[63] Continuation of Ser. No. 462,301, April 19, 1974.

[52] U.S. Cl. ..... 52/61; 52/62; 52/710; 52/98

[51] Int. Cl.[2] ..... E04D 13/14

[58] Field of Search ..... 52/98, 100, 58–62, 52/710, 364

[56] References Cited

UNITED STATES PATENTS

| | | | |
|---|---|---|---|
| 1,177,916 | 4/1916 | Alexander | 52/61 |
| 1,210,060 | 12/1916 | Gardner | 52/61 |
| 1,660,408 | 2/1928 | Bayley | 52/710 |
| 1,758,150 | 5/1930 | Elston | 52/710 |
| 2,822,762 | 2/1958 | Berg | 52/61 |
| 3,168,798 | 2/1965 | Berg | 52/62 |
| 3,319,384 | 5/1967 | Berg | 52/100 |
| 3,501,873 | 3/1970 | Berg | 52/11 |
| 3,512,318 | 5/1970 | Turner | 52/100 |

FOREIGN PATENTS OR APPLICATIONS

| | | | |
|---|---|---|---|
| 1,333,580 | 6/1963 | France | 52/98 |
| 1,456,972 | 9/1966 | France | 52/62 |
| 1,013,217 | 12/1965 | United Kingdom | 52/710 |

*Primary Examiner*—Price C. Faw, Jr.
*Assistant Examiner*—Henry Raduazo
*Attorney, Agent, or Firm*—Norman H. Gerlach

[57] ABSTRACT

A reglet channel having an unimpaired apron depending from the outer edge of its upper flange down to the level of the outer edge of its lower flange to protect the sealing compound in the interior of the channel from the deleterious effects of rain and sunlight, i.e., softening, seepage, drying-out and shrinkage. For ease in manufacture by extrusion processes, the lower marginal portion of the apron may be integral with the lower flange of the channel and may be provided with a single groove in its outer surface extending parallel and adjacent to the outer edge of the lower flange. After installation in a wall the reglet channel may be slit open along this groove to provide access to its interior for engagement of the retaining lip of the flashing. The apron, if unimpaired, provides the additional advantage of holding the installed flashing in position without the need for retaining wedges. Thus, it saves the cost of special retaining components for the flashing and the cost of labor for the installation of these components.

2 Claims, 3 Drawing Figures

Fig. 1
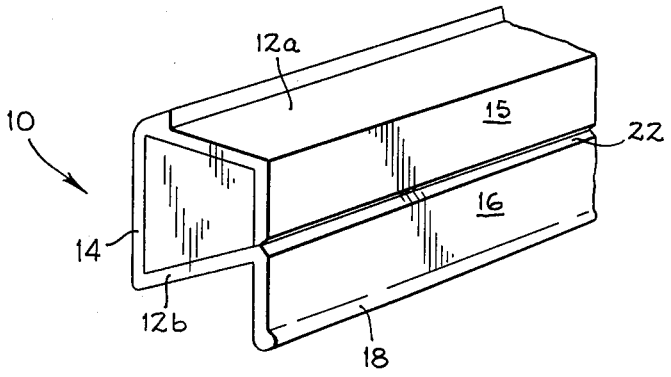
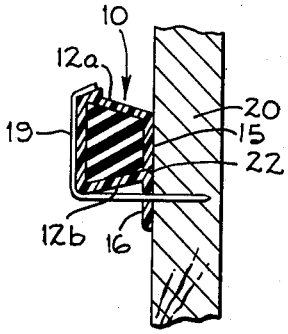
Fig. 2
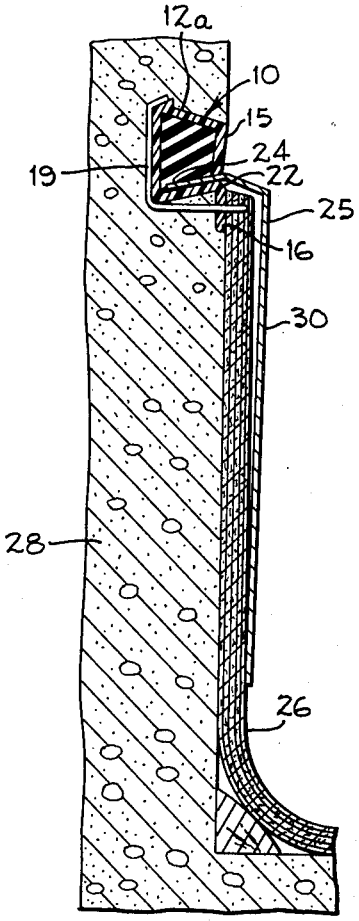
Fig. 3

REGLET STRUCTURE

This application is a continuation of my patent application Ser. No. 462,301, filed on Apr. 19, 1974 and entitled "REGLET STRUCTURE."

Background of the Invention

The present invention relates to the channel structures which are known as reglets and are employed to support cover structures, such as flashings in a seepage-tight manner from walls, parapets and roofs. Reglets are frequently filled with sealing compounds to preclude the entry or intrusion of moisture. It is a time and labor saving practice to fill the reglets with the sealing compound at the place of manufacture and ship them in prefilled condition to their places of use. This makes it necessary to cover the openings of the channels with tapes in separate operations so that the sealing compound will not flow out during shipping and subsequent handling when the reglets are installed. It is also necessary to cover the openings of prefilled reglets before they are installed in walls, i.e., before concrete is poured around them to prevent the intrusion of liquid concrete into their interior. This in turn necessitates the subsequent removal of the covers in separate operations before the flashings can be installed; and once the flashings are installed, it requires retaining wedges of wood, metal, rubber or plastic material to keep the flashings in their proper positions. Again this means additional components and requires experienced labor for securing the flashings in place so that they may serve their functions properly. Moreover there is the danger that the sealing compound within the prefilled reglets may soften and seep from the interior of the reglets or may dry out and shrink and thus no longer be able to serve its intended function of excluding moisture from the interior of the reglets.

OBJECTS OF THE INVENTION

It is an object of the present invention to provide a reglet structure that will avoid these harmful and costly phenomena in the manufacture, shipping, installation and performance of reglets.

More particularly it is an object of the invention to provide a reglet structure wherein the sealing material or compound in its interior is protected from the deleterious effects of heat, sunlight and rain so that it will not seep from the interior of the reglet nor dry out and shrink and thus fail to fill out the interior of the reglet.

Another object of the invention is to provide a reglet structure within which the flashing once installed is held in place without need for special retaining components, such as wedges.

BRIEF DESCRIPTION OF THE DRAWINGS

FIG. 1 is a fragmentary perspective of a presealed reglet structure embodying the invention;

FIG. 2 is a section through the form wall or panel of a concrete structure, with the reglet of the invention attached to it; and FIG. 3 is a section through a finished concrete wall into which the reglet of my invention has been incorporated, with a lip-equipped flashing engaged into and held in position by and within the reglet.

SUMMARY OF THE INVENTION

In accordance with the invention I provide the outer edge of the upper flange of a reglet channel with a comparatively stiff protective apron which depends from and is integral with said upper flange and which reaches down to the level of the outer edge of the lower flange of the reglet channel. During practical use of the reglet this apron protects the sealing compound in the reglet channel from the harmful effects of weather conditions, especially sunlight so that on the one hand it will not soften and seep out of the channel, and on the other hand it will not dry out and shrink and thus fail in its function to prevent the entry or intrusion of moisture into the interior of the channel. In addition the presence of the comparatively stiff, solid apron if unimpaired with the protected sealing compound behind it, renders it unnecessary to provide special wedges to hold the flashing in position thus saving not only the cost of separate retaining components but most of all the cost of skilled labor in applying the wedges to the reglet-flashing combination. The lower marginal portion of the apron may initially be integral with the lower flange of the reglet channel and contain in its outer surface a single V-shaped longitudinal groove extending parallel and adjacent to the outer edge of the lower flange of the reglet channel. After the pre-filled reglet has been installed in a wall, the lower marginal portion of the apron may be separated from the lower flange of the reglet channel and access be provided to the interior of the channel for the flashing, by slitting it along the groove with a roofer's knife and then swinging the apron inwards and upwards to a small extent.

DETAILED DESCRIPTION OF A PREFERRED EMBODIMENT OF THE INVENTION

Having reference to the drawing, the reglet structure of my invention comprises a channel 10 of extruded plastic material having upper and lower flanges **12*a* and 12*b*, respectively, that may be arranged in forwardly converging planes as shown, and which are connected at their diverged ends by a bight portion 14. Depending from the free end of the upper flange 12*a* and integral therewith is an apron 15 which reaches down to the level of the outer end of the lower flange 12*b* and which may be integral with said lower flange so that initially the reglet channel is in fact tubular. Depending from the outer edge of the lower flange 12*b* is a relatively short lip 16 which terminates in an outwardly directed bead 18. This lip and its bead enable the reglet to be attached in its proper position by means of "J" type nails 19 to the wooden form wall or other form panel 20 of a mold for concrete structures, such as walls or windows, as more particularly shown in FIG. 2.**

In case the lower marginal portion of the apron 15 is integral with the lower flange **12*b* of the channel 10 and the reglet of the invention is closed all around and is in fact tubular, the outer surface of the apron 15 is provided with a single longitudinal V-shaped groove 22 that extends adjacent and parallel to the outer longitudinal edge portion of the lower flange 12*b*. The described reglet whether filled with sealing compound or not, is easy to ship and to handle. When the reglet is tubular as shown, it is easy to fill with a sealing compound by extruding the compound laterally into the reglet from one of its ends, and no masking tape or strip between the outer edge portions of the upper and lower flanges 12***a* and 12*b* is necessary to retain the compound in the reglet channel during the prefilling process and during shipping, and no masking strip or tape is necessary to prevent entrance of liquid concrete into the interior of the reglet channel when the concrete wall or other structure is formed around it. As clearly shown in the drawings, the outer surface of the apron is smooth or uninterrupted throughout except for the single longitudinal groove 22, and in addition, it is of uniform thickness throughout its entire area except for its longitudinally grooved portion. When the time has come to install the flashing, it is merely necessary for the workman to slit the apron 15 along the groove 22 with a roofer's knife or other tool. Thus, access is provided for the insertion of the retaining lip 24 of a flashing 25, as illustrated in FIG. 3 which shows the reglet installed in a concrete wall 28 with superposed layers of tar paper 26 held against the wall 28 to protect it from moisture, and the cover portion 30 of the flashing 25 overlying the paper layers to prevent entrance of moisture into the space between the wall 28 and the upper edges of the paper layers 26. Due to the presence of the apron 15 on the reglet 10 and the stiff solid and unimpaired character of said apron, the installed flashing is held securely within the reglet channel as shown in FIG. 3, without need for special retaining or anchoring components, such as the retaining wedges that are now commonly employed to hold flashings in position within reglets. Furthermore, the apron 15 protects the sealing compound within the reglet for extended periods of time against the deleterious effects of weather, especially sunlight, without need to provide a protective masking tape, so that it will not soften and seep from the interior of the reglet or dry out and shrink as occurred after a relatively short time in the past. As shown in FIG. 3 of the drawings, when the retaining lip 24 at the upper margin of the flashing 25 is inserted into the interior of the channel and into the lower portion of the sealing compound within the channel, it swings the apron 15 inwards and upwards to a small extent so that it extends inwards and downwards and frictionally engages said retaining lip in such manner as effectively to hold it in place within the channel interior.

The new reglet structure of my invention is easy to manufacture and prefill with sealing compound; it is easy to handle during shipping and installation; it makes it unnecessary to apply protective masking strips to prevent escape of the sealing compound through seepage, and intrusion of moisture and concrete during the construction of the wall. It also makes it unnecessary to provide special retaining components after the flashing has been installed to hold the flashing in position. It protects and preserves the sealing compound within the reglet channel without special shielding means in spite of exposure of the reglet to direct sunlight for extended periods of practical use.

Having thus described the invention what I claim as new and desire to secure by letters patent is:

1. As a new article of manufacture, a one-piece reglet formed of extruded plastic material, adapted to be embedded in a concrete structure adjacent to one surface thereof and to hold lip-equipped flashing in place against said one surface of the concrete structure, and comprising a channel consisting of spaced apart upper and lower flanges, a substantially flat connecting bight portion extending between and connected to the inner longitudinal edge portions of the flanges, and an apron extending between and connected to the outer longitudinal edge portions of said flanges and disposed originally in substantially parallel relation with the bight portion, said flanges converging substantially uniformly in the direction of the apron, said channel being adapted in connection with formation of the concrete structure to have its apron fit flatly against a form panel while wet concrete is poured around it and against said form panel in order to form said concrete structure, and being also adapted upon hardening of the concrete and removal of the form panel to have its apron exposed as well as lie in the plane of the surface which is formed on the concrete structure by way of the form panel, said apron of the channel being provided in its outer surface and adjacent and parallel to the outer longitudinal edge portion of the lower flange with a single longitudinal groove, having its outer surface smooth and uninterrupted except for said single longitudinal groove, and being adapted after removal of the form panel and longitudinal slitting of its longitudinally-grooved portion to be swung inwards and slightly upwards so that it extends inwards and downwards, provides such access to the interior of the channel as to permit entry therein of the lip of the flashing, and serves so frictionally to grip such lip as to hold the flashing in place without the use of wedges or auxiliary anchoring elements.

2. A reglet according to claim 1 and wherein the apron is of uniform thickness throughout its entire area except at its longitudinally-grooved portion.

* * * * *